US010410617B2

(12) United States Patent
Roberts

(10) Patent No.: US 10,410,617 B2
(45) Date of Patent: Sep. 10, 2019

(54) PANEL FOR SOUND SUPPRESSION

(71) Applicant: Flare Audio Technologies Limited, West Sussex (GB)

(72) Inventor: Davies Roberts, Sussex (GB)

(73) Assignee: Flare Audio Technologies Limited (GB)

( * ) Notice: Subject to any disclaimer, the term of this patent is extended or adjusted under 35 U.S.C. 154(b) by 252 days.

(21) Appl. No.: 15/542,995

(22) PCT Filed: Jan. 13, 2016

(86) PCT No.: PCT/GB2016/050076
§ 371 (c)(1),
(2) Date: Jul. 12, 2017

(87) PCT Pub. No.: WO2016/113561
PCT Pub. Date: Jul. 21, 2016

(65) Prior Publication Data

US 2018/0025713 A1 Jan. 25, 2018

(30) Foreign Application Priority Data

Jan. 14, 2015 (GB) ..... 1500556.4
Oct. 1, 2015 (GB) ..... 1517394.1

(51) Int. Cl.
*G10K 11/16* (2006.01)
*E01F 8/00* (2006.01)
(Continued)

(52) U.S. Cl.
CPC ..... *G10K 11/16* (2013.01); *E01F 8/0076* (2013.01); *H04R 1/2888* (2013.01); *E04B 2001/8428* (2013.01)

(58) Field of Classification Search
CPC ..... G10K 11/16; E01F 8/0076; H04R 1/2888; E04B 2001/8438
(Continued)

(56) References Cited

U.S. PATENT DOCUMENTS

2013/0048417 A1* 2/2013 Nair ..... G10K 11/168 181/292
2014/0166391 A1* 6/2014 Swallowe ..... G10K 11/172 181/207
(Continued)

FOREIGN PATENT DOCUMENTS

AU 5414286 9/1986
FR 2487818 2/1982
(Continued)

OTHER PUBLICATIONS

Great Britain Search Report for Great Britain Application No. 1500556.4 dated Jul. 6, 2015.
(Continued)

*Primary Examiner* — Forrest M Phillips
(74) *Attorney, Agent, or Firm* — Tumey L.L.P.

(57) ABSTRACT

A panel (10) for sound suppression consists of a multiplicity of rigid elements (12) that extend parallel to each other, with gaps between adjacent rigid elements. Within each gap a vortex chamber (15) is defined to attenuate acoustic waves. The elements (12) may have curved edge portions (14), the edge portions (14) of adjacent elements (12) overlapping to define the vortex chamber (15), and also defining a first channel (16*a*) and a second channel (16*b*) communicating with the vortex chamber (15) at its periphery and aligned with a tangential component, such that if a fluid were to flow in through either channel (16*a* or 16*b*) the fluid would enter the vortex chamber (15) with a rotational sense relative to the vortex chamber (15), the rotational sense being the same for both the channels (16*a*, 16*b*). Such a sound-attenuating
(Continued)

panel may for example be used as part of a wall of a loudspeaker housing (50).

16 Claims, 5 Drawing Sheets

(51) Int. Cl.
*H04R 1/28* (2006.01)
*E04B 1/84* (2006.01)

(58) Field of Classification Search
USPC ..... 181/293, 292, 284, 229, 214
See application file for complete search history.

(56) References Cited

U.S. PATENT DOCUMENTS

| | | | | |
|---|---|---|---|---|
| 2014/0212265 | A1 | 7/2014 | Putnam | |
| 2016/0111076 | A1* | 4/2016 | Qian | C04B 26/12 181/293 |

FOREIGN PATENT DOCUMENTS

| | | |
|---|---|---|
| JP | 5189972 | 4/2013 |
| WO | 2014147378 | 9/2014 |

OTHER PUBLICATIONS

International Search Report and Written Opinion for Application No. PCT/GB2016/050076 dated Jun. 10, 2016.

* cited by examiner

PANEL FOR SOUND SUPPRESSION

This invention relates to a panel for sound suppression, for example for use as part of a loudspeaker housing, or of a compressor housing, or as a sound suppressing panel within a room or auditorium, or adjacent to a noise source such as a motorway.

Considering a loudspeaker housing in which a driver or cone is mounted, as the driver oscillates it creates sound waves in the air behind the driver as well as in the air outside the loudspeaker. The sound waves behind the driver may be contained within the enclosure, if the enclosure is substantially rigid and has no apertures or ports through which the sound waves can emerge. However, with such an enclosed space behind the driver, the pressure fluctuations in the air behind the driver can impede the movement of the driver, and so distort the sound; this problem can be minimised by having a sufficiently large enclosed space. Alternatively, if the space behind the driver is provided with an aperture or port through which the sound waves can emerge, this avoids the problems that arise from pressure fluctuations, but on the other hand there may be interference between sound waves produced by the front of the driver and those produced by the back of the driver and which emerge through the port. This issue is particularly of concern with loudspeakers for producing low frequencies, because of the size of the driver. It would therefore be desirable to be able to suppress the sound waves behind the driver.

Sound suppression is also required in buildings where echoes are detrimental to the acoustic properties, for example in an auditorium or concert hall. Sound suppression is also required where there are sources of noise, such as where motorways run alongside residential areas. In such cases impermeable walls may be used, but these will tend to reflect sound back onto the motorway which is unpleasant for vehicle drivers, and will be subjected to wind loading so they must be structurally sound.

SUMMARY OF THE INVENTION

According to the present invention there is provided a panel for sound suppression, the panel comprising a multiplicity of rigid elements that extend parallel to each other, with gaps between adjacent rigid elements, and within each gap a vortex chamber is defined to attenuate acoustic waves.

In a preferred embodiment the rigid elements have curved edge portions, the edge portions of adjacent elements overlapping each other, the overlapping edge portions of adjacent elements defining between them the vortex chamber, and also defining a first channel and a second channel communicating with the vortex chamber at the periphery of the vortex chamber and aligned with a tangential component relative to the vortex chamber, such that if a fluid were to flow in through the first channel or in through the second channel the fluid would enter the vortex chamber with a rotational sense relative to the vortex chamber, the rotational sense being the same for the first channel and the second channel.

The rigid elements may be interconnected by links between the rigid elements, and the elements and links may be integral with each other, that is to say the entire panel may be one integral structure. Alternatively the rigid elements may be separate components that are fixed together. To ensure that the widths of the first channel and of the second channel do not vary as a result of relative movement of the rigid elements, ribs or protrusions may be defined on one or both of the overlapping edge portions, these ribs or protrusions holding the overlapping edge portions at a desired separation while not significantly restricting fluid flow through the first channel or the second channel. Alternatively or additionally the rigid elements may be secured to support strips that extend transversely across the rigid elements, so holding the rigid elements together. Such support strips may be provided at one or both faces of the panel. The resulting panel may be flat, with all the rigid elements in the same plane, or alternatively the panel may be curved.

The vortex chamber means a chamber within which a cylindrical vortex may form if air flows into it. The walls defining the vortex chamber are cylindrical in part. If air were to flow in through the first channel, it would enter the vortex chamber with a particular rotational sense, and would therefore tend to form a vortex. Furthermore the orientation of the second channel is such that this vortex would inhibit airflow out through the second channel.

The first channel and the second channel may have a portion of uniform width at the end that communicates with the vortex chamber, and may have a portion of gradually increasing width remote from the vortex chamber.

Each rigid element may also comprise at least one pair of projecting curved ribs at different intermediate positions between the edge portions, the pair consisting of a shorter curved rib and a longer curved rib, arranged such that when the edge portions of adjacent elements overlap each other, a shorter curved rib of one element extends within the longer curved rib of the adjacent element so as to define between them a secondary vortex chamber. Preferably, in this case, the adjacent elements also define a first secondary channel and a second secondary channel communicating with the secondary vortex chamber at the periphery of the secondary vortex chamber and aligned with a tangential component relative to the secondary vortex chamber, such that if a fluid were to flow in through the first secondary channel or in through the second secondary channel the fluid would enter the secondary vortex chamber with a rotational sense relative to the secondary vortex chamber, the rotational sense being the same for the first secondary channel and the second secondary channel, and wherein the first secondary channel communicates at a position remote from the secondary vortex chamber with either the first channel or the second channel.

It will be appreciated from the observations above that the secondary vortex chamber means a chamber within which a cylindrical vortex may form, and that the walls defining the secondary vortex chamber are cylindrical in part. If there are two such pairs of projecting curved ribs on each rigid element, then in one case the secondary vortex chamber communicates through the first secondary channel with the first channel, and in the other case the secondary vortex chamber communicates through the first secondary channel with the second channel.

It will consequently be appreciated that the resulting panel is fluid permeable. In the case where no projecting curved ribs are provided, a through-channel is defined between adjacent rigid elements by the first channel, the vortex chamber, and the second channel. Where one pair of projecting curved ribs are provided the through-channel is defined in part by a secondary vortex chamber which is in series with the vortex chamber; while if two such pairs of projecting curved strips are provided the through-channel is defined in part by a secondary vortex chamber, and the vortex chamber, and a second secondary vortex chamber, all of which are in series. Thus each such flow path through the panel includes at least one chamber in which a vortex is formed, the inlet and outlet being such that any vortex flow generated by the inlet will inhibit outflow through the outlet.

Surprisingly it has been found that when sound waves are incident on the panel the sound waves follow such a vortex path, and the sound waves are inhibited from passing through the through-channel. Sound waves that are incident on the panel at one face (which may be called the front face) may follow the through-channel rather than being reflected off the front face, but the intensity of sound waves that emerge from the other end of the through-channel, at the rear face of the panel, is considerably decreased. Consequently the panel reduces the intensity of reflected sound, while also reducing the intensity of transmitted sound emerging from the rear surface.

It has also been found beneficial to provide vortex chambers in series, where the vortex chambers are of different radial dimensions, as this can enhance the suppression of transmitted sound at particular wavelengths. Consequently in a panel that defines secondary vortex chambers, it is desirable if the secondary vortex chambers are of different radial dimensions to the vortex chambers. The vortex chambers are of greater width than the channels that communicate with them; and similarly the secondary vortex chambers are of greater width than the channels that communicate with them. Preferably the width of the vortex chamber is at least 1.5 times greater and more preferably at least 2 times greater, such as 5 or 6 times greater, or 10 or more times greater, than the width of the corresponding channels; and the same is true for the secondary vortex chambers.

The orientation of the elements is not generally significant. For example where the panel is of rectangular shape, it is usually more convenient if the elements are of consistent length, so the elements may all extend parallel to the longer side of the rectangle, or may all extend parallel to the shorter side of the rectangle. Where a circular sound-absorbing panel is to be formed, it may be formed of multiple parallel elements of different lengths whose ends are curved to define the perimeter of the circle. The elements are specified as being rigid, but may be made of a wide range of different materials. In some cases they may be made of a plastic, or a fibre-reinforced plastic material. Alternatively they may be made of sheet steel or another metal; and in some applications they may be made of concrete.

In another aspect the present invention provides a rigid element for use in such a panel.

In a further aspect the present invention provides a loudspeaker housing in which at least one wall of the housing comprises such a panel.

The invention will now be further and more particularly described, by way of example only, and with reference to the accompanying drawings.

BRIEF DESCRIPTION OF THE DRAWINGS

Referring now to FIG. 1, a panel 10 consists of multiple rigid elements 12 that are arranged so as to intermesh. The elements 12 may be of any desired length, and may for example be made of any rigid material that is suited to their application, such as plastic or metal (e.g. aluminium); they may for example be formed by extrusion. Alternatively the elements 12 may be formed by 3-D printing, for example by fast filament forming. The panel 10 may be of any desired width, determined only by the number of elements 12 used to make the panel 10.

Referring also to FIGS. 2 and 3 each element 12 is S-shaped in cross-section and end view. As shown in FIGS. 1 and 2 the elements 12 are arranged such that the edge portions 14 of adjacent elements 12 overlap so as to create a cylindrical vortex chamber 15 (indicated in part by broken lines) and two channels 16*a* and 16*b* communicating with opposite faces of the panel 10 and with the vortex chamber 15. Each such channel 16*a* and 16*b* communicates tangentially with the periphery of the vortex chamber 15, and both are oriented such that any air flowing in through each channel 16*a* and 16*b* would flow with the same rotational sense around the vortex chamber 15: in this example it would be anticlockwise for each channel 16*a* and 16*b* as shown. Each channel 16*a* and 16*b* is of substantially uniform width in the vicinity of the vortex chamber 15, and then widens out as it comes to the face of the panel 10. The vortex chamber 15 may be of width between 20 mm and 50 mm, for example of width between 25 mm and 35 mm. In one example the vortex chamber 15 is of width 31 mm, and the channels 16*a* and 16*b* are of width 5 mm or 6 mm.

Air can therefore flow through the panel 10. However the more rapidly the air tries to flow through the panel 10 the greater the extent to which it will tend to form a vortex within the vortex chambers 15. Whichever channel 16*a* or 16*b* the air flows into the vortex chamber 15 through, the vortex will be anticlockwise as indicated by the arrows 18, and the vortex will therefore inhibit the outflow of air because of the orientation of the other channel 16*a* or 16*b*. It has been found that similar phenomena occur with sound. If sound waves are incident on one face of the panel 10, much of the sound energy will pass along the channel 16*a* or 16*b* into the vortex chamber 15, and little sound energy is reflected. The sound wave consists of regions of increased pressure and regions of decreased pressure, and these tend to cancel each other out within the vortex chamber 15. Consequently little sound energy is transmitted through the panel 10.

Figure 1:
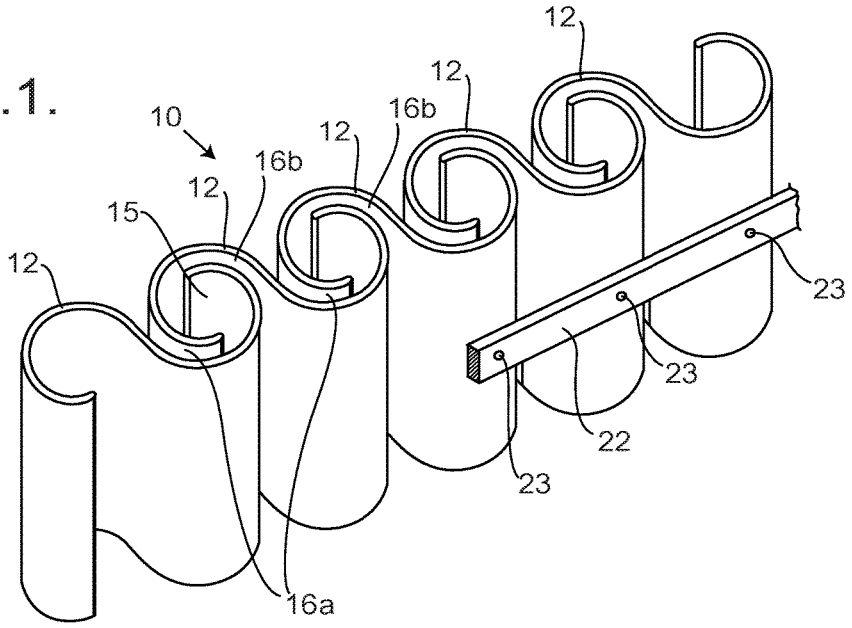
FIG. 1 is a perspective view of a panel of the invention.
Figure 2:
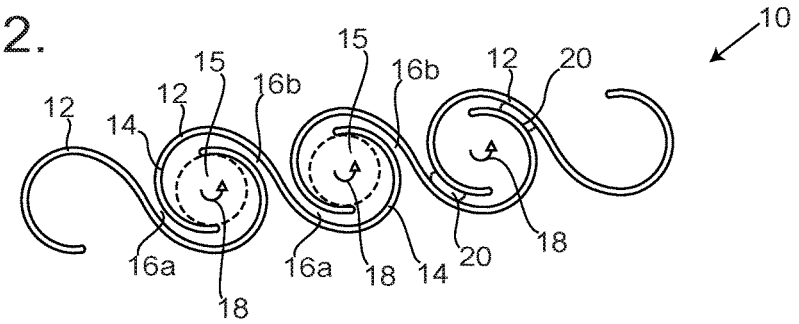
FIG. 2 shows an end view of the panel of FIG. 1.

The spacing between the successive elements 12 may be maintained by inserts, protrusions or ridges within the channels 16*a* and 16*b*, as indicated by broken lines at 20 (in FIG. 2). Indeed, an insert may be a sheet cut into the shape (as shown) of the vortex chamber 15 and the connecting channels 16*a* and 16*b*, so that the cut out sheet holds the successive elements 12 in the required relative positions, and subdivides the vortex chamber 15 along its longitudinal axis. Alternatively or additionally the spacing may be ensured by attaching the elements 12 to support strips 22 by respective bolts or rivets 23, as illustrated in FIG. 1, the support strips 22 extending transversely across the panel 10 to hold the rigid elements 12 together. Such support strips 22 may be provided at one or both faces of the panel. The panel 10 may be flat, with corresponding parts of all the elements 12 lying in the same plane (so for example the longitudinal axes of all the vortex chambers 15 are coplanar), or alternatively the panel 10 may be curved.

Figure 4:
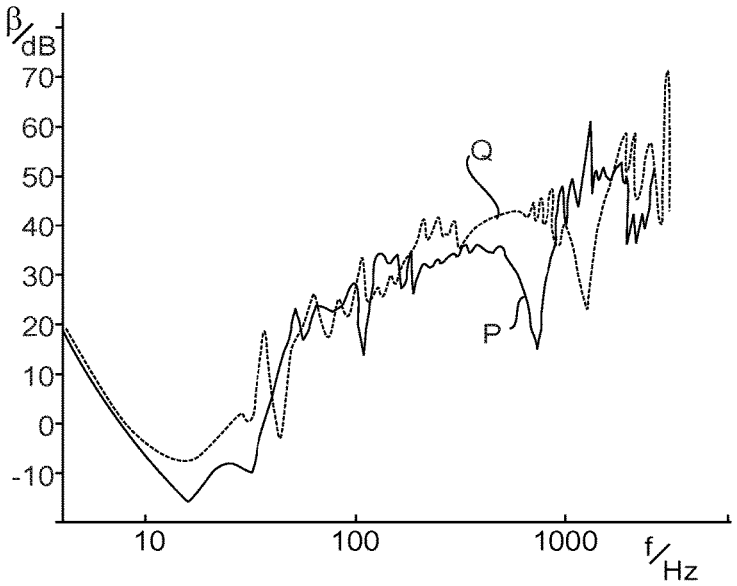
FIG. 4 is a graphical view showing the variation with frequency of the transmission loss for normal incidence on a panel of the invention, with different sizes of vortex chamber.

Referring now to FIG. 4, this shows graphically the variation in the transmission loss β(in decibels), for sound incident along the normal to one face of the panel 10, as observed in the vicinity of the opposite face of the panel 10, for a range of different frequencies f. The frequency f is on a logarithmic scale. The results are shown for vortex chambers 15 of different sizes, the solid line P indicating the results for a vortex chamber 15 of diameter 31 mm and the broken line Q indicating the results for a vortex chamber 15 of diameter half that size. It will be appreciated that for all frequencies above about 30 Hz the transmission loss β generally increases with frequency, at least up to about 2000 Hz. It will also be observed that for the larger vortex chamber 15 (see line P) there is a localised reduction in the transmission loss β at a frequency of about 700 Hz, while for the smaller vortex chamber 15 (see line Q) there is a similar localised reduction in the transmission loss β at a frequency of about 1250 Hz. The transmission loss β is indicative of the attenuation of sound passing through the panel 10.

Figure 5A:
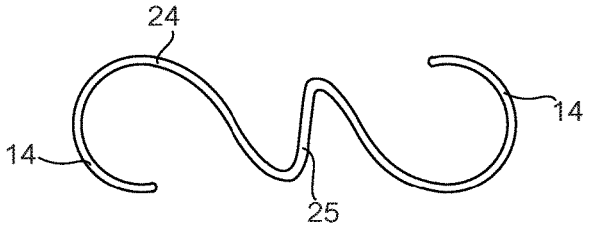
FIGS. 5*a* and 5*b* show end views of modifications to the element of FIG. 3.

Referring now to FIG. 5*a* there is shown an end view of an element 24 which is a modification to the element 12. The element 24 has edge portions 14 identical to those of the element 12, that is to say of the same shape and size, but the edge portions 14 are interconnected by a zigzag portion 25 so that each element 24 is somewhat wider. Elements 24 can be assembled into a panel in exactly the same way as described above for the elements 12. This enables a panel of a desired width to be formed with fewer elements 24 as compared to the elements 12, but such a panel would be somewhat less effective at sound absorption, because there would be fewer vortex chambers 15.

Figure 5B:
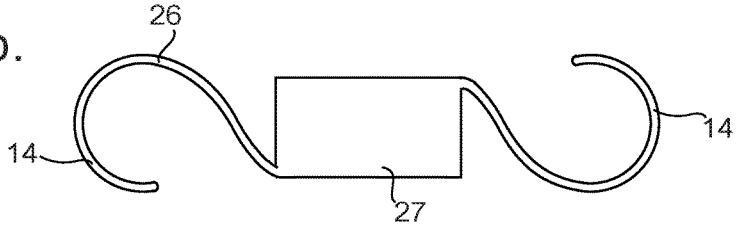

Referring now to FIG. 5*b* there is shown an end view of an element 26 which is an alternative modification to the element 12. The element 26 has edge portions 14 identical to those of the elements 12 and 24 in shape and size, but the edge portions 14 are interconnected by a thicker plate portion 27, so each element 26 is wider than the element 12. These elements 26 can be assembled into a panel as described above, but like the elements 24 such a panel would provide fewer vortex chambers 15 than are provided by the corresponding panel 10.

Figure 6:
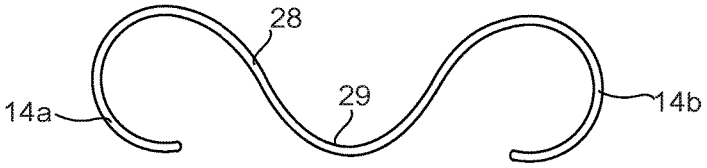
FIG. 6 shows an end view of an alternative modification to the element of FIG. 3.

Referring now to FIG. 6 there is shown an end view of an element 28 which is another alternative modification to the element 12. In this case the element 28 has one edge portion 14*a* identical to the corresponding edge portion 14 of the element 12; and along the opposite edge has an edge portion 14*b* which is a mirror image to the edge portion 14*a*. The two curved edge portions 14*a* and 14*b* are joined by an oppositely curved central portion 29. Multiple elements 28 can be assembled together as described above, although in this case alternate elements 28 must be turned around, for example turning through 180° about a longitudinal axis, so that edge portions 14*a* of adjacent elements 28 overlap, and edge portions 14*b* of adjacent elements 28 overlap; the convex surfaces of the central portions 29 of adjacent elements 28 are consequently at opposite faces of the resulting panel.

Although the elements 24, 26 or 28 may be used to form a sound-suppressing panel, the spacing across the panel between successive gaps, that is to say between successive curved edge portions 14 and so between successive vortex chambers 15, is somewhat greater than with the elements 12. In each of the elements 24, 26 and 28 there is a central portion—the zigzag portion 25, the plate portion 27, and the curved central portion 29 respectively—which does not contribute to defining the vortex chambers 15 or the connecting channels 16, and which may reflect sound energy. Consequently for most purposes the S-shaped elements 12 are preferable. Nevertheless there may be contexts in which the elements 24, 26 or 28 may be advantageous; and in any event the elements 24, 26 or 28 may be used in combination with the elements 12, for example to obtain a panel of a predetermined width.

Figure 7:
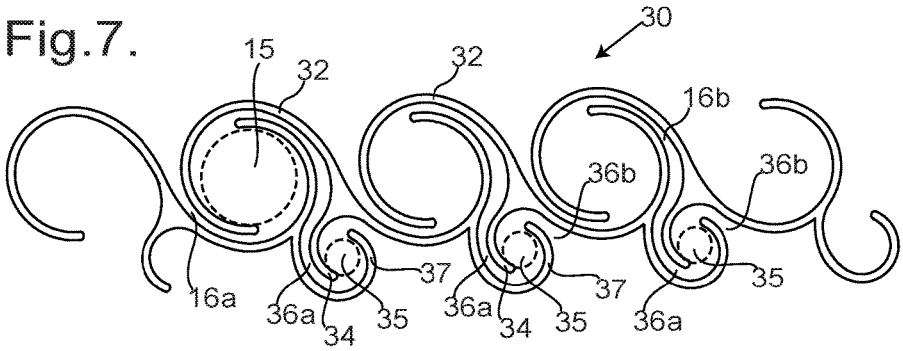
FIG. 7 shows an end view of an alternative panel of the invention.

Benefits may arise by providing vortex chambers through which the sound must pass in series. Referring now to FIG. 7, an alternative panel 30 of the invention consists of multiple rigid elements 32 that are arranged so as to intermesh. The elements 32 may be of any desired length, and as mentioned above they may for example be made of plastic or metal (e.g. aluminium), and may for example be formed by extrusion or by 3-D printing. The panel 30 may be of any desired width, determined only by the number of elements 32 used to make the panel 30.

Figure 8:
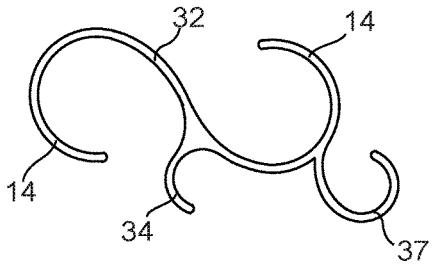
FIG. 8 shows an end view of an element of the panel of FIG. 7.

Referring also to FIG. 8 each element 32 has edge portions 14 that are identical to those of the elements 12, and as described above the edge portions 14 of adjacent elements 32 overlap so as to create a cylindrical vortex chamber 15 as described above and two channels 16*a* and 16*b* that communicate with the vortex chamber 15 as described above. The channel 16*a* communicates with one face of the panel 30.

Each element 32 also defines two curved ribs: a shorter curved rib 34 and a longer curved rib 37. As seen in FIG. 7, when the elements 32 are assembled into the panel 30 the shorter curved ribs 34 are within the longer curved ribs 37, and define between them a secondary vortex chamber 35 (indicated in broken lines); in addition a channel 36*a* is defined between the shorter curved rib 34 and part of the inner surface of the longer curved rib 37, and a channel 36*b* is defined between part of the outer surface of the longer curved rib 37 and the adjacent portion of the element 32. Each such channel 36*a* and 36*b* communicates tangentially with the periphery of the vortex chamber 35, and both are oriented such that any air flowing in through each channel 36*a* and 36*b* would flow with the same rotational sense around the vortex chamber 35: in this example it would be anticlockwise for each channel 36*a* and 36*b* as shown. Each channel 36*a* and 36*b* is of substantially uniform width in the vicinity of the vortex chamber 35; the channel 36*a* communicates with the channel 16*b*, gradually widening away from the secondary vortex chamber 35, whereas the channel 36*b* widens out as it comes to the face of the panel 30. In this example the width of the vortex chamber 35 is about four times greater than the width of the channel 36*a* or of the channel 36*b*.

It will thus be appreciated that the panel 30 defines through-channels from the front face to the rear face, and that each such channel includes two vortex chambers 15 and 35 which are in series as regards fluid flow. In this example the vortex chambers 15 and 35 have different radial dimensions, and can be expected to be complementary in their effect on attenuating sound transmission. As discussed above in relation to FIG. 4, the attenuation created by such a vortex may be affected to some extent by the radial dimensions of the vortex chamber. By providing two vortex chambers 15 and 35 of different radial dimensions it can be expected that any frequency that is only partially attenuated by one vortex chamber will be further attenuated by the other vortex chamber.

Figure 9:
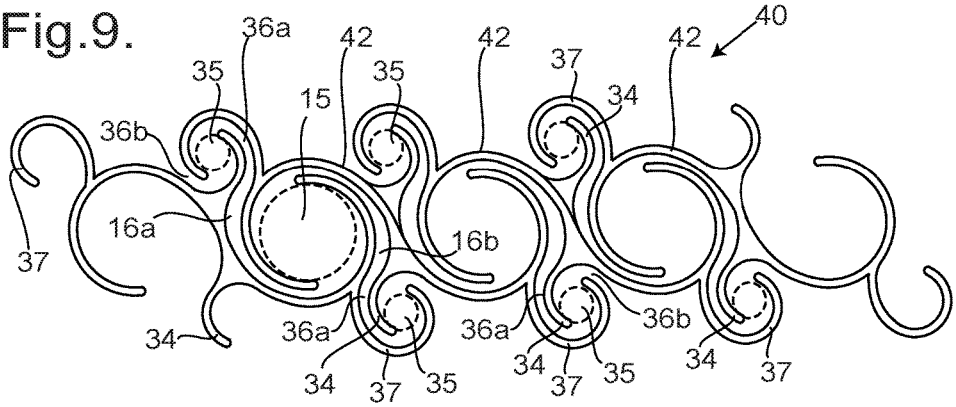
FIG. 9 shows an end view of another alternative panel of the invention.

Greater attenuation of sound may be obtainable by providing a larger number of vortex chambers in series. Referring now to FIG. 9, an alternative panel 40 of the invention consists of multiple rigid elements 42 that are arranged so as to intermesh. The elements 42 may be of any desired length, and as mentioned above they may for example be made of plastic or metal (e.g. aluminium), and may for example be formed by extrusion or 3-D printing. The panel 40 may be of any desired width, determined only by the number of elements 42 used to make the panel 40.

Figure 10:
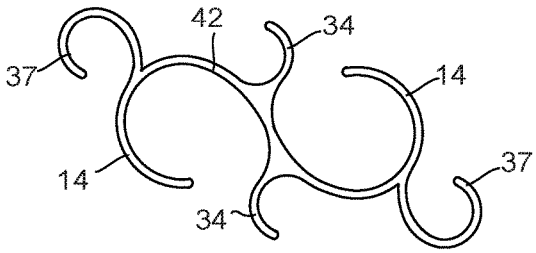
FIG. 10 shows an end view of an element of the panel of FIG. 9.

Referring also to FIG. 10 each element 42 has edge portions 14 that are identical to those of the elements 12, and as described above the edge portions 14 of adjacent elements 42 overlap so as to create a cylindrical vortex chamber 15 as described above and two channels 16*a* and 16*b* that communicate with the vortex chamber 15 as described above. However, in this case neither of the channels 16*a* and 16*b* communicates with a face of the panel 40.

Each element 42 also defines two pairs of curved ribs, with one such pair of curved ribs on each side of the element 42. As described in relation to the panel 30, each such pair of curved ribs consists of a shorter curved rib 34 and a longer curved rib 37. As seen in FIG. 9, when the elements 42 are assembled into the panel 40 the shorter curved ribs 34 are within the longer curved ribs 37 on each side of the panel 40, and define between them a secondary vortex chamber 35 (indicated in broken lines); in addition a channel 36*a* is defined between the shorter curved rib 34 and part of the inner surface of the longer curved rib 37, and a channel 36*b* is defined between part of the outer surface of the longer curved rib 37 and the adjacent portion of the element 42. These features are substantially identical to those of the panel 30, the difference being that there are vortex chambers 35 at both faces of the panel 40.

It will thus be appreciated that the panel 40 defines through-channels from the front face to the rear face. For example, starting at the top of the panel 40 (as shown in FIG. 9), the through path consists of the tapering channel 36*b*, the vortex chamber 35, the channels 36*a* and 16*a*, the vortex chamber 15, the channels 16*b* and 36*a*, the vortex chamber 35, and the channel 36*b* that widens out to the bottom of the panel 40 (as shown). Thus each such through-channel includes three vortex chambers 15 and 35 which are in series as regards fluid flow and as regards the propagation of sound. This can therefore be expected to be even more effective at suppressing sound transmission.

Preferably each vortex chamber 15 and 35 has a diameter at least twice the width of each channel 16 or 36 that communicates with it. In the examples described above each vortex chamber 15 is five or six times wider than the connecting channels 16. Similarly each secondary vortex chamber 35 is about four times wider than the connecting channels 36.

Figure 10A:
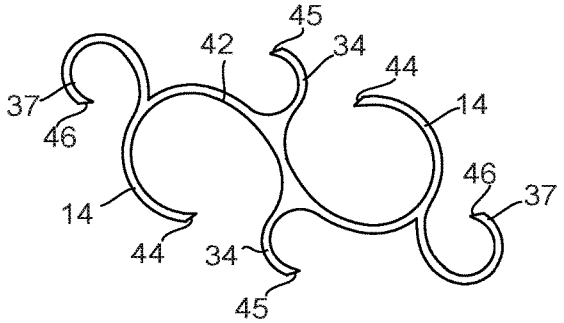
FIG. 10*a* shows an end view of a modification to the element of FIG. 10.

Although the pairs of ribs 34 and 37 on opposite faces of each element 42 are shown as being of the same sizes, and so creating vortex chambers 35 of the same sizes, the pairs of ribs 34 and 37 on opposite faces may instead be of different sizes, so as to create vortex chambers 35 of different radial sizes. In a further modification the edges of the edge portions 14, and the edges of the projecting curved ribs 34 and 37, may taper to a sharp edge, which may help in vortex formation within the vortex chambers 15 and the secondary vortex chambers 35; this is illustrated in FIG. 10*a*, where the edge portions 14 have sharp edges 44, while the ribs 34 and 37 have sharp edges 45 and 46.

Figure 11:
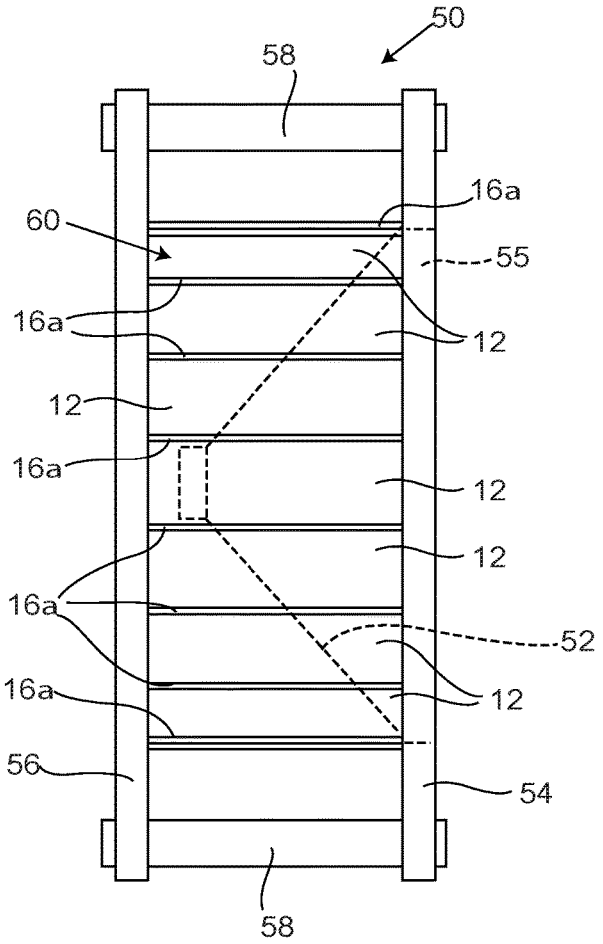
FIG. 11 shows a side view of a loudspeaker housing incorporating a panel of the invention.

Referring now to FIG. 11 there is shown a loudspeaker housing 50, in which a loudspeaker driver 52 (shown in broken lines) may be mounted. The loudspeaker housing 50 consists of a front plate 54 defining an aperture 55 (indicated in broken lines) behind which the driver 52 is mounted; a rear plate 56; and a cylindrical side wall 60. The front plate 54 and the rear plate 56 are circular, of larger diameter than the side wall 60, and are held together by bolts 58 around the periphery (only two of which are shown).

Figure 3:
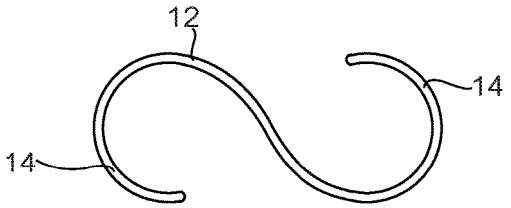
FIG. 3 shows an end view of a single element of the panel of FIG. 1.

In this example the side wall 60 is similar to the panel 10, as it consists of a plurality of rigid elements 12 as shown in FIG. 3 which overlap as described in relation to FIG. 2, but which define a cylindrical surface rather than a flat surface. In this example the rigid elements 12 are of extruded plastic; and the ends of the elements 12 locate in correspondingly-shaped recesses, i.e. roughly S-shaped grooves, defined in the front plate 54 and the rear plate 56, which ensures they are held in correct relative positions to define the vortex chambers 15 between them. The channels 16*a* open out to the outer surface of the side wall 60.

When the driver 52 oscillates it generates sound waves from both its front surface and its rear surface. The sound waves from the rear surface are within the chamber defined in part by the cylindrical sidewall 60. As described above, the propagation of sound waves through the gaps between the rigid elements 12 is suppressed by the vortex chambers 15, and consequently the sound from the rear surface of the driver 52 is attenuated rather than interfering with that from the front surface.

It will be appreciated that a loudspeaker housing may differ from that shown here, for example in having four flat panels 10 as shown in FIG. 1 to define a rectangular or square side wall, rather than the cylindrical sidewall 60 of the housing 50.

If further attenuation of the sound waves from the rear surface of the driver 52 is required, this may be achieved by providing an additional vortex chamber through which the sound must propagate. For example the cylindrical wall might be made of rigid elements 32 as described above, so that there are two vortex chambers in series; or might be made of rigid elements 42 as described above, so that there are three vortex chambers in series. Alternatively the loudspeaker housing may have two side walls, one inside the other, each side wall consisting of a plurality of rigid elements that define vortex chambers 15 between them, for example having the shape of the elements 12, so that the vortex chambers 15 defined by the inner side wall are in series with the vortex chambers 15 defined by the outer side wall. The rigid elements 12 making up the inner side wall may be of a different geometrical size (in cross-section) to those that form the outer side wall, so that the corresponding vortex chambers 15 are of different radial dimensions.

In the loudspeaker housing 50 of FIG. 11, each rigid element 12 is of length equal to the separation between the front plate 54 and the rear plate 56 plus the depth of the recesses. The resultant vortex chambers 15 are therefore of length equal to the separation between the front plate 54 and the rear plate 56. In some cases it has been found to be advantageous to provide vortex chambers 15 that are shorter. This may be achieved by replacing each rigid element 12 with a plurality of shorter elements 12 placed end to end, successive shorter elements 12 being separated by a flat plate. In the loudspeaker housing 50, the side wall 60 is of cylindrical shape, so each such flat plate could be annular, its radial width being substantially equal to the radial width of each rigid element 12.

Figure 12:
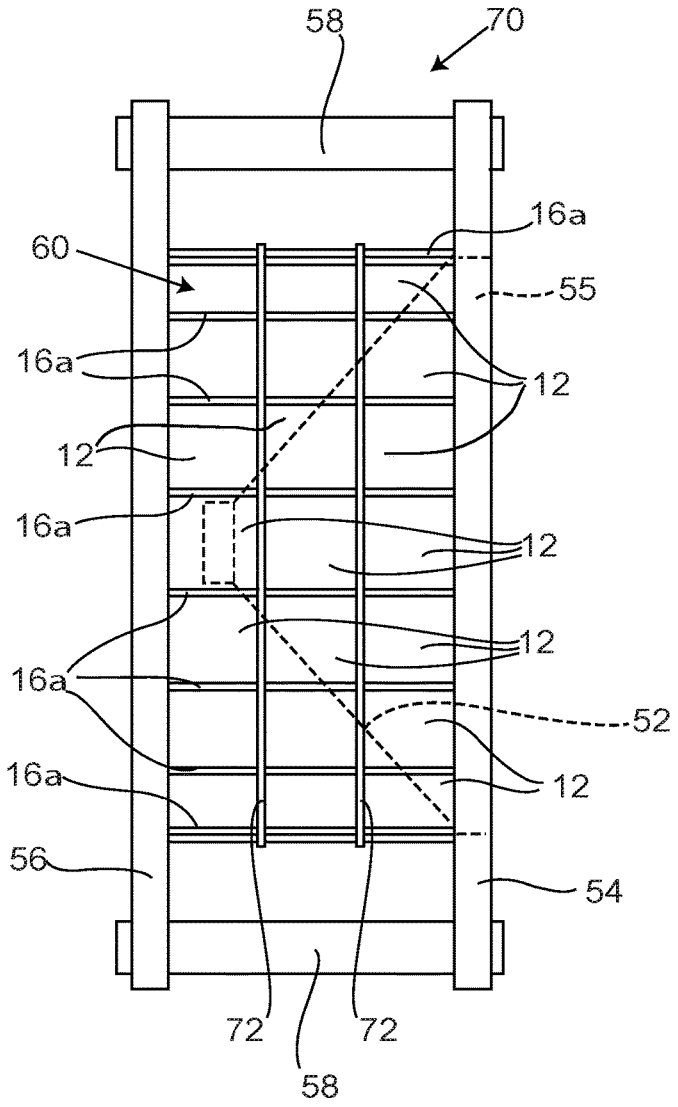
FIG. 12 shows a side view of a modification to the loudspeaker housing of FIG. 11.

So, referring to FIG. 12, this shows a loudspeaker housing 70 that differs from the loudspeaker housing 50 only in that each rigid element 12 is replaced by three rigid elements 12 of length about one third that of the separation between the front plate 54 and the rear plate 56, separated by two flat annular plates 72. More generally there may be N rigid elements 12 of length about 1/N times the separation arranged end to end, and the N rigid elements 12 would be separated by (N−1) such flat annular plates 72. This has the effect that each vortex chamber 15 is of length about 1/N times the separation between the front plate 54 and the rear plate 56. As with the front plate 54 and the rear plate 56, each flat annular plate 72 may define S-shaped grooves with which the ends of the rigid elements 12 mate.

In the loudspeaker 70 there are thus three sets of rigid elements 12, each set forming a generally cylindrical wall, and all the rigid elements 12 therefore extend parallel to each other in a longitudinal direction, and as shown the rigid elements 12 of one set are aligned with the rigid elements 12 of the adjacent set. In a further modification the rigid elements 12 of one set are not aligned with the rigid elements 12 of the adjacent set, that is to say one set is staggered relative to the adjacent set. Indeed the rigid elements 12 of one set may be of a different shape to those of the adjacent set, for example being of a different length.

The cylindrical wall of the loudspeaker 70 defines vortex chambers 15 whose axial length is about one third of the separation between the front plate 54 and the rear plate 56. If a cylindrical wall of different height is required, this can be achieved either by changing the number, N, of rigid elements 12 that are arranged end to end, or by changing the length of the rigid elements 12. It has been found that in some applications the sound attenuation can be improved by using rigid elements 12 that define vortex chambers 15 whose axial length is less than 30 mm, more preferably less than 20 mm.

It will thus be appreciated that the present invention provides panels for sound suppression that may be used in a wide variety of applications, and may be formed in a variety of different sizes for different uses. In every case the panels provide gaps through which air can flow, while inhibiting sound transmission by attenuating the sound, and reducing sound reflection. By way of example a panel like the side wall 60 described above in the context of a loudspeaker housing would also be applicable in constructing a housing for a different source of sound such as a compressor, a motor, or a generator. A single panel may be used as a sound-suppressing ceiling tile or wall panel or room divider within a building, or to construct a sound-suppressing fence or barrier adjacent to a source of noise such as a factory or motorway. It will also be appreciated that the material of which the panel is made would be selected to suit its application. For example the panels might be made of a metal such as steel or aluminium, or a composite material such as fibre-reinforced plastic, or of plastic material. For some applications other materials such as concrete may be suitable.

Other variations and modifications will be apparent to the skilled person. Such variations and modifications may involve equivalent and other features that are already known and which may be used instead of, or in addition to, features described herein. Features that are described in the context of separate embodiments may be provided in combination in a single embodiment. Conversely, features that are described in the context of a single embodiment may also be provided separately or in any suitable sub-combination.

It should be noted that the term "comprising" does not exclude other elements or steps, the term "a" or "an" does not exclude a plurality, a single feature may fulfil the functions of several features recited in the claims and reference signs in the claims shall not be construed as limiting the scope of the claims. It should also be noted that the Figures are not necessarily to scale; emphasis instead generally being placed upon illustrating the principles of the present invention.

What is claimed:

1. A panel for sound suppression, the panel comprising a multiplicity of rigid elements that extend parallel to each other, with gaps between adjacent rigid elements, and within each gap a vortex chamber is defined to attenuate acoustic waves, wherein the rigid elements have curved edge portions, the edge portions of adjacent elements overlapping each other, the overlapping edge portions of adjacent elements defining between them the vortex chamber, and also defining a first channel and a second channel communicating with the vortex chamber at the periphery of the vortex chamber and aligned with a tangential component relative to the vortex chamber, such that if a fluid were to flow in through the first channel or in through the second channel the fluid would enter the vortex chamber with a rotational sense relative to the vortex chamber, the rotational sense being the same for the first channel and the second channel.

2. A panel as claimed in claim 1 in which a width of the gap between successive rigid elements in the panel is maintained by inserts, protrusions or ridges within the first and second channels.

3. A panel as claimed in claim 1 wherein the width of the vortex chamber is at least twice the width of the first channel and at least twice the width of the second channel.

4. A panel as claimed in claim 1 also comprising linking elements to interconnect the rigid elements and to hold the rigid elements together with a desired width of the gaps.

5. A panel as claimed in claim 1 wherein each rigid element also defines at least one pair of projecting curved ribs at different intermediate positions between the edge portions, the pair consisting of a shorter curved rib and a longer curved rib, arranged such that when the edge portions of adjacent elements overlap each other, a shorter curved rib of one element extends within the longer curved rib of the adjacent element so as to define between them a secondary vortex chamber.

6. A loudspeaker housing in which at least one wall of the housing comprises a panel as claimed in claim 5.

7. A panel as claimed in claim 5 wherein the rigid elements, when arranged with the edge portions of adjacent elements overlapping each other, also define a first secondary channel and a second secondary channel communicating with the secondary vortex chamber at the periphery of the secondary vortex chamber and aligned with a tangential component relative to the secondary vortex chamber, such that if a fluid were to flow in through the first secondary channel or in through the second secondary channel the fluid would enter the secondary vortex chamber with a rotational sense relative to the secondary vortex chamber, the rotational sense being the same for the first secondary channel and the second secondary channel, and wherein the first secondary channel communicates at a position remote from the secondary vortex chamber with either the first channel or the second channel.

8. A panel as claimed in claim 5 wherein the vortex chamber defined by the curved edge portions and the secondary vortex chamber defined by the pair of projecting curved ribs are of different radial dimensions.

9. A panel as claimed in claim 7 wherein the width of the secondary vortex chamber is at least twice the width of the first secondary channel and at least twice the width of the second secondary channel.

10. A panel as claimed in claim 1 comprising a plurality of sets of rigid elements that extend in a longitudinal direction parallel to each other, with gaps in each set between adjacent rigid elements, and with a vortex chamber defined within each gap, wherein the sets of rigid elements are arranged in succession in the longitudinal direction, and the panel also includes a plate between each successive set of rigid elements such that each plate defines an end to the vortex chambers defined by adjacent sets of rigid elements.

11. A panel as claimed in claim 10 wherein an axial length of each rigid element is less than 30 mm.

12. A panel as claimed in claim 10 wherein the rigid elements in successive sets are aligned with each other.

13. A rigid element for use in a panel as claimed in claim 1, the rigid element comprising means to define a vortex chamber when placed adjacent to another such rigid element.

14. A rigid element as claimed in claim 13 that has edge portions along opposed edges that are curved in opposite directions.

15. A rigid element as claimed in claim 14 that is of S-shaped cross-section.

16. A loudspeaker housing in which at least one wall of the housing comprises a panel as claimed in claim 1.

* * * * *